US005293844A

United States Patent [19]

Threatt

[11] Patent Number: 5,293,844

[45] Date of Patent: Mar. 15, 1994

[54] PROTECTIVE SHIELD FOR THE ELECTRICAL COMPONENTS OF A WATER HEATER

[75] Inventor: Gary S. Threatt, Kershaw, S.C.

[73] Assignee: AOS Holding Company, Milwaukee, Wis.

[21] Appl. No.: 46,427

[22] Filed: Jun. 4, 1993

[51] Int. Cl.[5] ..... F22B 37/36

[52] U.S. Cl. ..... 122/494; 122/13.1; 126/361; 126/373; 126/374; 220/444; 392/449; 264/46.7; 174/5 R

[58] Field of Search ..... 126/344, 361, 373, 374; 220/444, 445, 447, 902, 429, 448; 122/494, 13.1, 18; 392/449; 174/5 R, 138 F; 264/46.7, 46.9, 45.2

[56] References Cited

U.S. PATENT DOCUMENTS

| | | | |
|---|---|---|---|
| 3,621,197 | 11/1971 | Place | 392/449 |
| 4,543,445 | 9/1985 | Turner | 392/449 |
| 4,790,290 | 12/1988 | Chevalier et al. | 126/361 |
| 5,052,346 | 10/1991 | Beck | 126/361 |
| 5,101,471 | 3/1992 | Bill | 392/449 |
| 5,117,810 | 6/1992 | Threatt | 126/373 |
| 5,163,119 | 11/1992 | Windon | 126/361 |

*Primary Examiner*—James C. Yeung

*Attorney, Agent, or Firm*—David R. Price; James Earl Lowe, Jr.

[57] ABSTRACT

A water heater comprising a tank for holding water, a jacket surrounding the tank, foam insulation between the tank and the jacket, a heating element for heating water in the tank, and a thermostat mounted on the tank for controlling the heating element in response to the temperature of water in the tank. The thermostat includes electrically active terminals, leadwires connected to the terminals, an electric circuit reset, and a temperature adjustment dial. The water heater also comprises a protective shield for covering the terminal and preventing foam contact with the terminal. The shield includes a face portion covering the thermostat in spaced relation to the tank. The face portion comprises a first access port for providing operator access to the circuit reset cutoff, and a second access port spaced from the first access port for providing operator access to the temperature adjustment dial. The shield also includes sidewall portions extending between the face portion and the tank. Each sidewall portion has a rearward tapered surface sealingly engaging the tank, and a leadwire access port which provides an opening for routing a leadwire and which provides strain relief for the leadwire.

12 Claims, 2 Drawing Sheets

PROTECTIVE SHIELD FOR THE ELECTRICAL COMPONENTS OF A WATER HEATER

BACKGROUND OF THE INVENTION

The invention relates to water heaters, and more particularly to water heaters having foam insulation injected between the tank and the outer jacket. Still more particularly, the invention relates to a protective shield for protecting the electrical components of the water heater from contact with the injected foam insulation.

It is known to provide a dam which surrounds the electrical components and which extends between the tank and the outer jacket in order to protect the electrical components from contact with the foam insulation. It is also known to provide a protective shield to cover the electrical components of the water heater to prevent accidental contact between the operator and the electrical components and yet provide access to the water heater controls.

SUMMARY OF THE INVENTION

The invention provides a water heater including a tank and a jacket surrounding the tank. Foam insulation is injected between the tank and the jacket to reduce the amount of heat lost from the hot water by conduction through the tank. The water heater also includes means for heating water in the tank, and a thermostat mounted on the tank. The thermostat includes control circuitry having electrically active terminals, leadwires connected to the terminals, an electric circuit reset and temperature adjustment means.

The water heater further includes a protective shield covering the thermostat to prevent contamination thereof by the injected foam. The shield includes a planar, vertical face portion which covers the thermostat and which is spaced from the tank. The face portion includes a first opening providing operator access to the circuit reset, and a second opening providing operator access to the temperature adjustment means. The shield also includes a pair of planar, generally vertical sidewall portions extending between the face portion and the tank. Each sidewall portion includes a rearward tapered surface sealingly engaging the tank, and leadwire access ports for routing the leadwires and for relieving strain on the leadwires.

The water heater also includes a bracket and means for securing the bracket to the tank so that the bracket draws the rearward sidewall surfaces into sealing contact with the outer surface of the tank.

A principal feature of the invention is the provision of a protective shield which has a pair of sidewall portions extending between the face portion and the outer surface of the tank to sealingly engage the tank when the protective shield is secured to the tank.

Another feature of the invention is the provision of a protective shield having sidewall portions that have therein openings for routing thermostat leadwires and that also provide strain relief for the leadwires.

Other features and advantages of the invention will become apparent to those skilled in the art upon review of the following detailed description, claims and drawings.

Figure 1:
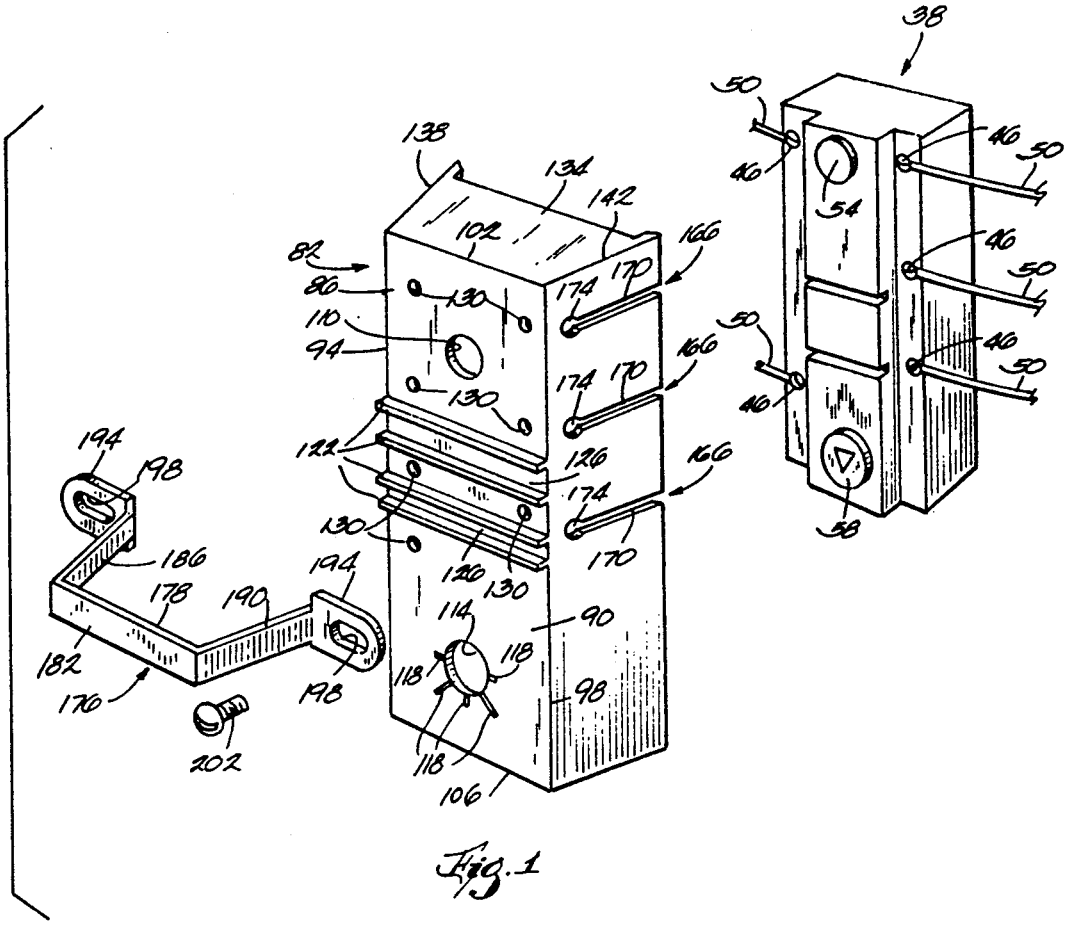
FIG. 1 is an exploded perspective view of the thermostat, protective shield and bracket of a water heater embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
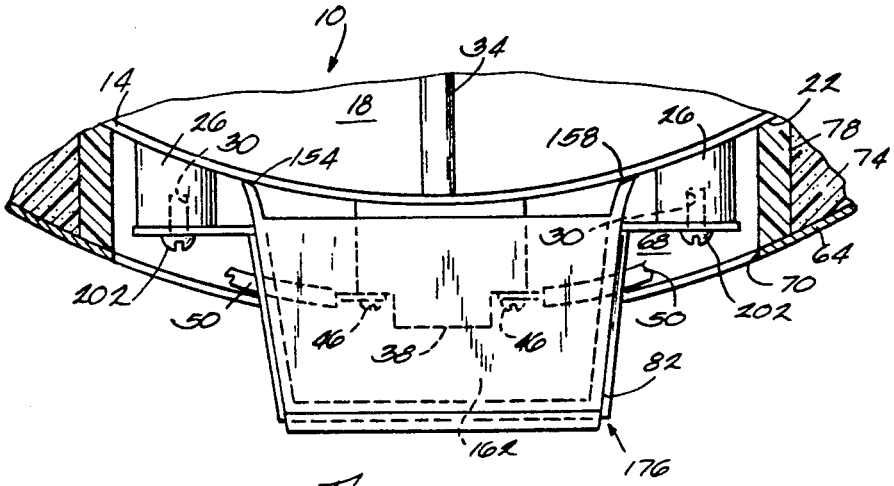
FIG. 2 is a partial horizontal sectional view of the water heater.

Partially shown in FIG. 2 of the drawings is a water heater 10 including a tank 14 for holding water. The tank 14 defines a water compartment 18 and has an outer cylindrical surface 22. The outer surface 22 of the tank 14 has thereon a pair of horizontally-spaced threaded studs 26. Each threaded stud 26 extends outwardly relative to the outer surface 22. The water heater 10 also includes at least one heating element 34 extending into the water compartment 18 to selectively heat the water in the compartment 18.

A thermostat 38 is mounted on the outer surface 22 of the tank 14 between the studs 26. The thermostat 38 detects the tank water temperature and controls the heating element 34 as is known in the art. The thermostat 38 includes electric control circuitry having electrically active terminals 46 and leadwires 50 connected to the terminals 46. The thermostat 38 also includes a circuit reset 54, which prevents excessive high temperature that must be manually reset after functioning, and a temperature adjustment means 58, which allows an operator to adjust the desired tank water temperature. The thermostat 38 is conventional and need not be described in greater detail.

The water heater 10 also includes a cylindrical jacket 64 which surrounds the tank 14 and provides a space 68 between the tank outer surface 22 and the jacket 64. The jacket 64 has therein an opening 70 affording access to the thermostat 38. Insulating foam 74 is injected into the space 68 to reduce the amount of heat lost from the hot water in the tank 14. As is known in the art, a dam 78 is provided between the tank 14 and the jacket 64 to surround, and provide protection for, the thermostat 38 and heating element 34.

The water heater 10 further includes a protective shield 82 that covers the thermostat 38, provides additional protection against contact between the electrical components and the foam insulation 74, reduces the liklihood of accidental contact between the operator and the electrical components, and allows operator access to the electric circuit reset 54 and the temperature adjustment means 58. The protective shield is preferably formed from an electrically insulating plastic capable of withstanding temperatures up to 200° Fahrenheit.

Figure 4:
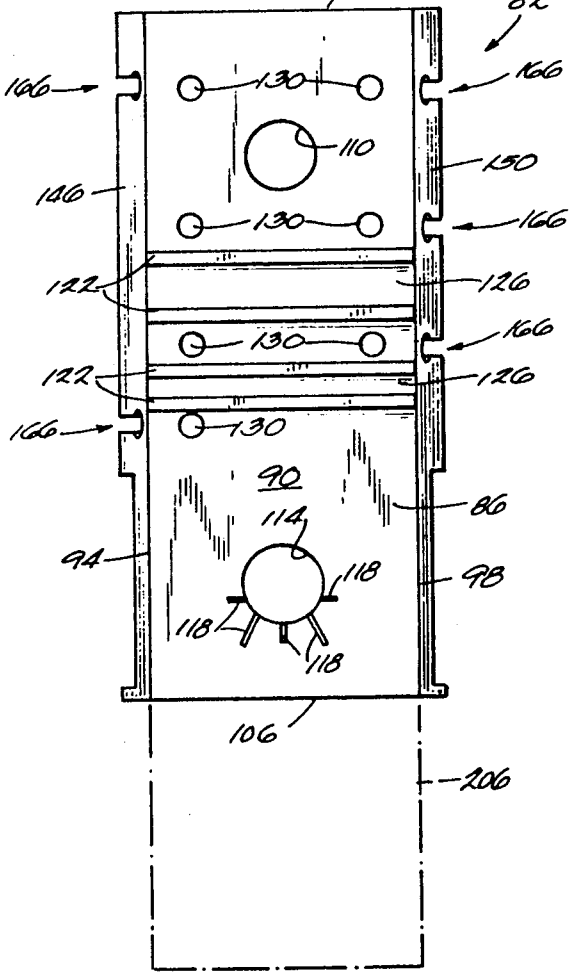
FIG. 4 is a front elevational view of the protective shield.

The protective shield 82 includes a vertically extending wall or face portion 86 which covers the thermostat 38 and which is spaced from the outer surface 22 of the tank 14. The face portion 86 is generally rectangular and includes an outer surface 90, a first vertically extending side edge 94, a second vertically extending side edge 98, a horizontally extending top edge 102 connecting the side edges 94 and 98, and a horizontally extending bottom edge 106 connecting the side edges 94 and 98. The face portion 86 has therein a first or upper opening 110 providing operator access to the electric circuit reset 54 of the thermostat 38. The face portion 86 also has therein a second or lower opening 114 providing operator access to the temperature adjustment means 58. As shown in FIGS. 1 and 4, the face portion 86 may include gradations 118 surrounding the lower opening 114. These gradations 118 represent water temperature settings and are useful to the operator in controlling the water heater 10.

Also included on the face portion 86 is a series of generally parallel ribs 122 extending horizontally across the outer surface 90 of the face portion 86 from the first side edge 94 to the second side edge 98. The ribs 122 combine to form a series of horizontal channels 126 extending across the face portion 86 of the protective shield 82. The purpose of these channels 126 is explained below. The face portion 86 also includes a plurality of access ports 130 aligned with the terminals 46. The terminals 46 and connected leadwires 50 may be accessed through the access ports 130 for production circuit tests or for maintenance. This testing or maintenance is facilitated with minimum exposure to electric shock.

The protective shield 82 also includes a horizontal, generally planar top wall 134. The top wall 134 is connected to the top edge 102 of the face portion 86 and extends from the face portion toward the outer surface 22 of the tank 14. The top wall 134 includes opposite side edges 138, 142 extending inwardly from the side edges 94, 98 of the face portion 86. In the preferred form of the invention, the top wall 134 substantially covers the space between the top edge 102 of the face portion 86 and the outer surface 22 of the tank 14; however, as shown in FIG. 2, the top wall 134 does not engage the outer surface 22 due to curvature of the tank outer surface.

Figure 5:
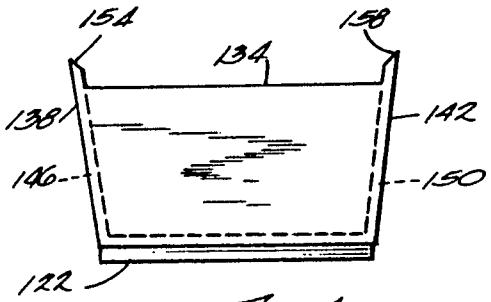
FIG. 5 is a top plan view of the protective shield.

The protective shield 82 also includes a first vertical, generally planar sidewall portion 146 connected to the first side edge 94 of the face portion 86 and to the first side edge 138 of the top wall 134, and a second vertical, generally planar sidewall portion 150 connected to the second side edge 98 of the face portion 86 and to the second side edge 142 of the top wall 134. In the preferred form of the invention, each sidewall forms an obtuse angle with the face portion 86 (best shown in FIGS. 2 and 5). The first sidewall portion 146 and the second sidewall portion 150 extend between the face portion 86 and the outer surface 22 of the tank 14 and both extend beyond the top wall 134 in the direction of the outer surface 22. The first sidewall portion 146 and the second sidewall portion 150 include respective rearward surfaces 154, 158 which are tapered so as to fit the general contour of the outer surface 22 of the tank 14. Together, the first sidewall portion 146, the second sidewall portion 150, the face portion 86, the top wall 134 and the outer surface 22 of the tank 14 define an enclosure 162 for the thermostat 38, which enclosure 162 is substantially impervious to the injected foam 74.

Each sidewall portion 146, 150 defines a plurality of vertically spaced, horizontal slots 166 extending forward from the respective rearward surface toward the face portion 86. The leadwires 50 are routed through the slots 166. Each slot 166 includes a channel 170 which extends from the respective rearward edge 154 or 158 and which terminates in a generally circular head 174. In the preferred embodiment, the channel 170 has a thickness of approximately 80% of the diameter of the leadwire to be routed therethrough. The head 174 preferably has a diameter of approximately 110% of the diameter of the leadwire to be routed therethrough. These dimensions allow the leadwires 50 to be routed from points outside the protective shield 82 through the heads 174 of the sidewall slots 166 for connection to the terminals 46. The oversized heads 174 allow the leadwires 50 to reach a strainless resting state before being lodged, using appropriate means, within the channel sections 170 of the slots 166 where the smaller diameter of the channels 170 prevents movement and vibration of the leadwires 50 relative to the sidewalls 146, 150 and thereby secures the leadwires 50 in their strainless positions.

The water heater 10 also includes a bracket 176 which, as shown in FIG. 2, has an inner surface 178 complementary with the protective shield 82. The bracket 176 includes a front portion 182 extending horizontally across the face portion 86 of the shield 82. The front portion 182 has a width less than the inner dimension of one of the channels 126 formed by the ribs 122, allowing the front portion 182 to be received in a channel. The bracket 176 also includes first and second side portions 186, 190 connected to the opposite ends of the front portion 182. The side portions 186, 190 of the bracket 176 extend from the front portion 182 toward the outer surface 22 of the tank 14 adjacent the first and second sidewall portions 146, 150 respectively. The rearward end of each side portion 186, 190 has thereon an outwardly extending tab 194. Each tab 194 engages a respective one of the studs 26 on the tank 14. Each tab 194 has therein a through-bore 198 for receiving a stud, bolt or other fastener. In the preferred embodiment, the fastener is a nut 202 threaded onto the studs 26.

The bracket 176 is dimensioned so that, when it is secured to the studs 26, the distance from the tank outer surface 22 to the front portion 182 of the bracket 176 is less than the distance from the outer surface 90 of the face portion 86 to the rearward surfaces 154, 158 of the sidewall portions 146, 150. This dimensional difference and the obtuse angle between the respective sidewall portions 146, 150 and the face portion 86 causes the sidewall portions 146, 150 to bow outwardly (as shown in FIG. 2), away from the thermostat 38 and tangentially relative to the outer surface 22, to bring the rearward tapered surfaces 154, 158 of the sidewall portions 146, 150 into substantially sealing contact with the tank surface 22. This substantially prevents foam from passing between the tank outer surface 22 and the sidewall portions 146, 150.

Figure 3:
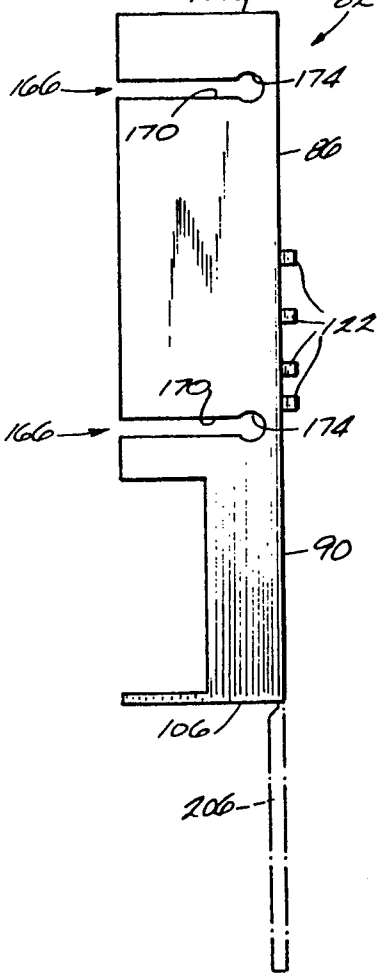
FIG. 3 is a side elevational view of the protective shield.

In an alternative embodiment of the invention, the protective shield 82 also includes a lower cover 206 (shown in phantom in FIGS. 3 and 4) pivotally connected to the bottom edge 106 of the face portion 86. The cover 206 provides additional protection for electrical components of the water heater 10, and protection from electric shock for the operator.

Various features of the invention are set forth in the following claims.

I claim:

1. A water heater comprising:

a tank for holding water;

a jacket surrounding said tank;

foam insulation between said tank and said jacket;

heating means for heating water in said tank;

a thermostat mounted on said tank for controlling said heating means in response to the temperature of water in said tank, said thermostat including an electrically active terminal, a leadwire connected to said terminal, an electric circuit reset, and temperature adjustment means;

a protective shield for covering said terminal and preventing foam contact with said terminal, said shield including a face portion covering said thermostat in spaced relation to said tank, said face portion comprising first means for providing operator access to said circuit reset, and second means spaced from said first means for providing operator access to said temperature adjustment means, said shield also including a first sidewall portion extending between said face portion and said tank, said first sidewall portion having a rearward tapered surface sealingly engaging said tank, and said first sidewall portion having therein a leadwire access port which provides an opening for routing said leadwire and which provides strain relief for said leadwire, and said shield further including a second sidewall portion extending between said face portion and said tank, said second sidewall portion having a rearward tapered surface sealingly engaging said tank; and means for releasably securing said shield to said tank.

2. A water heater as set forth in claim 1 wherein said means for releasably securing said shield to said tank comprises a bracket, a channel on said shield for receiving said bracket, and means for releasably securing said bracket to said tank.

3. A water heater as set forth in claim 2 wherein said tank defines a water chamber and has an outer cylindrical surface, and wherein connection of said bracket to said tank draws said sidewall surfaces into substantially sealing contact with said outer cylindrical surface.

4. A water heater as set forth in claim 3 wherein said first and second sidewall portions and said face portion are planar and wherein each of said first and second sidewall portions forms an obtuse angle with said face portion.

5. A water heater as set forth in claim 4 wherein said sidewall portions and said face portion are generally vertical.

6. A water heater as set forth in claim 5 wherein said face portion has a bottom edge, and wherein said shield includes a cover pivotally connected to said bottom edge.

7. An electrically insulating shield for a water heater, the water heater including a cylindrical tank, a thermostat having an electrically active terminal, and a leadwire connected to the terminal, said shield comprising:

a face portion adapted to cover the terminal in spaced relation to the tank and including means for providing access to the terminal;

a first sidewall portion which extends rearwardly from said face portion, said first sidewall portion having a rearward tapered surface adapted to sealingly engage the tank and further having therein a leadwire access port which provides an opening for routing the leadwire and which provides strain relief for the leadwire; and a second sidewall portion which extends rearwardly from said face portion, said second sidewall portion having a rearward tapered surface adapted to sealingly engage the tank.

8. An electrically insulating shield as set forth in claim 7 wherein said first and second sidewall portions and said face portion are planar and wherein each of said first and second sidewall portions forms an obtuse angle with said face portion.

9. An electrically insulating shield as set forth in claim 8 wherein said sidewall portions and said face portion are generally vertical.

10. An electrically insulating shield as set forth in claim 9 wherein said face portion has a bottom edge, and wherein said shield includes a cover pivotally connected to said bottom edge.

11. A water heater comprising:

a tank for holding water, said tank defining a water compartment and having an outer cylindrical surface;

heating means for selectively heating water in said compartment;

a thermostat mounted on said tank for detecting tank water temperature and for controlling said heating means in response to said tank water temperature, said thermostat including an electrically active terminal, a leadwire connected to said terminal, an electric circuit reset, and temperature adjustment means;

a bracket;

an electrically insulating shield covering said thermostat to prevent contamination of said terminal, said shield including a face portion covering said thermostat in spaced relation to said tank, a first opening in said face portion for providing operator access to said circuit reset, a second opening in said face portion for providing operator access to said temperature adjustment means, a channel on said face portion for receiving said bracket, a first planar, generally vertical sidewall portion extending between said face portion and said tank, said first sidewall portion having a rearward tapered surface sealingly engaging said tank outer surface and further having therein a leadwire access port providing an opening for routing said leadwire and providing strain relief for said leadwire, and a second planar, generally vertical sidewall portion extending between said face portion and said tank and having a rearward tapered surface engaging said tank outer surface in sealing relation, each of said first and second sidewall portions forming an obtuse angle with said face portion; and means for securing said bracket to said tank so that said bracket draws said sidewall surfaces into substantially sealing contact with said outer cylindrical surface.

12. A water heater as set forth in claim 11 wherein said shield includes a bottom edge and a cover pivotally connected to said bottom edge.

* * * * *